US010849410B2

(12) United States Patent
Ng

(10) Patent No.: US 10,849,410 B2
(45) Date of Patent: Dec. 1, 2020

(54) PRESSURE-RELIEVING BACK PACK

(71) Applicant: Pak To Petto Ng, Kowloon (HK)

(72) Inventor: Pak To Petto Ng, Kowloon (HK)

( * ) Notice: Subject to any disclaimer, the term of this patent is extended or adjusted under 35 U.S.C. 154(b) by 0 days.

(21) Appl. No.: 16/785,597

(22) Filed: Feb. 8, 2020

(65) Prior Publication Data

US 2020/0170388 A1 Jun. 4, 2020

Related U.S. Application Data

(63) Continuation of application No. PCT/CN2018/096372, filed on Jul. 20, 2018.

(30) Foreign Application Priority Data

Sep. 22, 2017 (CN) ..... 2017 1 0872394

(51) Int. Cl.

| | |
|---|---|
| ***A45F 3/04*** | (2006.01) |
| ***A45C 13/00*** | (2006.01) |
| *A45F 3/12* | (2006.01) |

(52) U.S. Cl.

CPC ..... *A45F 3/04* (2013.01); *A45C 13/001* (2013.01); *A45F 3/12* (2013.01)

(58) Field of Classification Search

CPC .... A45F 3/047; A45F 3/08; A45F 3/04; A45F 3/06; A45F 3/10; A45F 3/12; A45F 2003/045

See application file for complete search history.

(56) References Cited

U.S. PATENT DOCUMENTS 4,013,201 A * 3/1977 Potter ..... A45F 3/047 224/262
4,860,936 A * 8/1989 Lowe ..... A45F 3/047 224/632

(Continued)

FOREIGN PATENT DOCUMENTS

CN 101406343 A 12/2010
CN 204245436 U 4/2015

(Continued)

*Primary Examiner* — Corey N Skurdal

(57) ABSTRACT

A pressure-relieving back pack, comprising: a pack body (1), a pressure-relieving plate (2), a pressure-relieving assembly, two straps (4), and a supporting plate. The supporting plate is provided at a rear part of the pack body (1). The pressure-relieving plate (2) is provided at a side of the rear part of the pack body (1) near to the back. The pressure-relieving assembly comprises a spring mechanism and a hollow casing (33). The casing (33) is mounted at the rear part of the pack body (1). The spring mechanism is detachably provided inside the casing (33). The spring mechanism comprises a compression spring (31) and a retractable rod (32). The compression spring (31) is sleeved around and position-limited with respect to the retractable rod (32). A second end (322) of the retractable rod (32) and the compression spring (31) are position-limited within the casing (33). A first end (321) of the retractable rod (32) is located outside the casing (33) and can extend and retract upward and downward relative to a first end of the casing (33). The first end (321) of the retractable rod (32) and a lower end of the pressure-relieving plate (2) are detachably connected. An upper end of the pressure-relieving plate (2) is connected to an upper end of the strap (4). A lower end of the strap (4) is connected to a lower end of a back side of the pack body (1). The pressure-relieving back pack can meet different loading needs by changing the compression spring (31) of the pressure-relieving assembly.

11 Claims, 7 Drawing Sheets

(56) References Cited

U.S. PATENT DOCUMENTS

| | | | | | |
|---|---|---|---|---|---|
| 5,004,135 | A * | 4/1991 | Dufournet | A45F 3/047 | 224/262 |
| 5,503,314 | A * | 4/1996 | Fiscus | A45F 3/08 | 224/262 |
| 5,725,139 | A * | 3/1998 | Smith | A45F 3/02 | 224/631 |
| 6,619,523 | B1 * | 9/2003 | Duckworth | A45F 3/08 | 224/634 |
| 6,982,497 | B2 * | 1/2006 | Rome | A45F 3/08 | 224/579 |
| 7,851,932 | B2 * | 12/2010 | Rome | F03G 5/00 | 290/10 |
| 8,240,531 | B2 * | 8/2012 | Lam | A45F 3/04 | 224/631 |
| 9,545,144 | B2 * | 1/2017 | Gill | A45F 3/04 | |
| 10,342,318 | B2 * | 7/2019 | Winfield | A45F 3/047 | |
| 2006/0011689 | A1 * | 1/2006 | Reid | A45F 3/12 | 224/637 |
| 2012/0000948 | A1 * | 1/2012 | Maggi | A45F 3/08 | 224/262 |

FOREIGN PATENT DOCUMENTS

| | | | |
|---|---|---|---|
| CN | 105747477 | A | 10/2017 |
| CN | 107549983 | A | 1/2018 |
| CN | 207285554 | U | 5/2018 |

* cited by examiner

PRESSURE-RELIEVING BACK PACK

FIELD OF THE INVENTION

The invention relates to the technical field of backpacks, in particular to a pressure-relieving backpack.

BACKGROUND OF THE INVENTION

Backpacks are daily necessities. When a user is carrying a backpack on his/her shoulders, shoulder straps are main stress applying parts. Long-time carriage will easily make the user's shoulders fatigue, and then affect the user's health. If the shoulder straps are too hard, they will make the user feel heavy and even uncomfortable. If the shoulder straps are too soft, they will be too soft to carry heavy loads.

In order to reduce the pressure of a backpack on the shoulder, the traditional practice is to provide a loincloth at a lower end of the backpack, and the loincloth is buckled around the use's waist when the backpack is carried on shoulders. The method of providing a loincloth can only reduce the shoulder load to a limited extent; and when the backpack is loaded with heavy objects, there would be friction between the loincloth and the use's hipbone, which may cause discomfort.

At present, there is a better solution: anti-gravity is used to reduce pressure and improve the user's comfort when the backpack is carried on shoulders. For example, an anti-gravity backpack is disclosed in a patent application (CN105747477A), by providing a pressure reducing plate, a first elastic belt and a length fixing belt, the backpack moves up and down when it is carried by a user, which provides a cushioning effect for the user and can well relieve feeling of pressure transmitted to shoulders of the user due to loads. The resilience generated by the elastic belt reduces the force that the user needs to pay, and also reduces loads of the shoulders, so that the user seems to be in an anti-gravity space, thereby improving the user's comfort, as a result, the user can save effort and walk briskly.

However, in order to ensure that the elastic belt, the pressure reducing plate and the fixing belt can work stably, reliably and safely, it is employed in the technical solution that the connection among the pressure reducing plate, the first elastic belt, the length fixing belt and the backpack body must be a fixed connection. However, since the load of the backpack may vary greatly in different use environments, when the above components, especially the first elastic belt cannot be replaced in different use environments, a bad user experience may also be caused. For example, when the load of the backpack exceeds the rated load, the first elastic belt will be severely deformed and elongated. At this time, the stress region of the backpack body that is in contact with back (of the user) may be lowed, and the user may feel uncomfortable in the back due to improperly applied stress when the backpack is carried (by the user).

SUMMARY OF THE INVENTION

In order to solve the technical problem that the existing pressure-relieving backpacks cannot meet requirements of various different load applications, the invention provides a new type of pressure-relieving backpack which can meet different load use requirements by replacing pressure-relieving components.

In order to achieve the above objective, the invention provides a pressure-relieving backpack comprising a backpack body, a pressure-relieving plate, a pressure-relieving assembly, two shoulder straps, and a supporting plate for supporting the backpack body; the supporting plate is provided at a rear portion of the backpack body, the pressure-relieving plate is provided at a side of the rear portion of the backpack body near back;

the pressure-relieving assembly comprises a spring mechanism and a hollow casing; the casing is mounted at the rear portion of the backpack body, and the spring mechanism is detachably provided inside the casing;

the spring mechanism comprises a compression spring and a retractable rod, the compression spring is sleeved around and position-limited with respect to the retractable rod;

the casing and the retractable rod both have a first end and a second end; the second end of the retractable rod and the compression spring are position-limited within the casing, the first end of the retractable rod is located outside the casing and can be extended and retracted upward and downward relative to the first end of the casing;

the first end of the retractable rod is detachably connected to a lower end of the pressure-relieving plate, an upper end of the pressure-relieving plate is connected to upper ends of the shoulder straps, and lower ends of the shoulder straps are connected to a lower end of a back side of the backpack body.

In the aforementioned pressure-relieving backpack, the casing comprises two clamps, an inner wall of each of the clamps protrudes outwardly to form a slideway, two slideways are oppositely disposed, and the retractable rod is located in a chamber formed by the two slideways and can be extended and contracted upward and downward;

the two clamps are respectively referred as a first clamp and a second clamp, the first clamp is fixedly mounted on the rear portion of the backpack body, the slideway of the first clamp faces away from the backpack body, and the second clamp is detachably mounted on the first clamp.

In the aforementioned pressure-relieving backpack, a bottom of the second end of the retractable rod is provided with a base, and the base is position-limited within the chamber formed by the two slideways.

In the aforementioned pressure-relieving backpack, a top of the first end of the retractable rod is provided with a groove in an up-down direction, a thickness of the lower end of the pressure-relieving plate matches with a width of the groove, and the lower end of the pressure-relieving plate is detachably mounted in the groove.

In the aforementioned pressure-relieving backpack, an upper portion of the retractable rod is horizontally provided with connecting holes for realizing detachable connection between the lower end of the pressure-relieving plate and the first end of the retractable rod through a connecting member.

In the aforementioned pressure-relieving backpack, an upper end of the side of the rear portion of the backpack body near the back is further provided with a limiting sleeve that penetrates up and down, a side of the pressure-relieving plate opposite to the backpack body is vertically provided with an elastic belt, an upper end of the elastic belt is connected to the upper end of the pressure-relieving plate, and a lower end of the elastic belt passes through the limiting sleeve and is connected to the lower end of the pressure-relieving plate.

In the aforementioned pressure-relieving backpack, the rear portion of the backpack body is further provided with an insulation layer, and the supporting plate is disposed in the insulation layer.

In the aforementioned pressure-relieving backpack, the side of the rear portion of the backpack body near the back is further provided with a positioning portion for restricting left-and-right movement and front-and-rear movement of the pressure-relieving plate.

In the aforementioned pressure-relieving backpack, the positioning portion is a pocket with an opening formed upwardly, the pressure-relieving plate and the pressure-relieving assembly are both disposed in the pocket and can be extended and retracted up and down along the pocket.

In the aforementioned pressure-relieving backpack, the side of the rear portion of the backpack body near the back is further provided with two protection pads, and the two protection pads are respectively disposed at two sides of the pocket.

In the aforementioned pressure-relieving backpack, the protection pads are raised relative to the pocket.

Compared with the prior art, the invention has the following advantages:

Since the spring mechanism of the pressure-relieving assembly is detachably disposed in the casing, and the first end of the retractable rod is detachably connected to the lower end of the pressure-relieving plate, when the pressure-relieving backpack according to the invention is used in other load environments (e.g., in overload environment), a user can detach the first end of the retractable rod from the lower end of the pressure-relieving plate and detach the spring mechanism from the casing, replace the original compression spring on the retractable rod with a new compression spring that meets the use requirements in other load environments (e.g., in overload environment), and then reassemble the pressure-relieving assembly and remount the reassembled pressure-relieving assembly onto the backpack body. Therefore, the pressure-relieving backpack according to the invention can meet different load use requirements by replacing the compression spring in the pressure-relieving assembly.

BRIEF OF THE DRAWINGS

Figure 1:
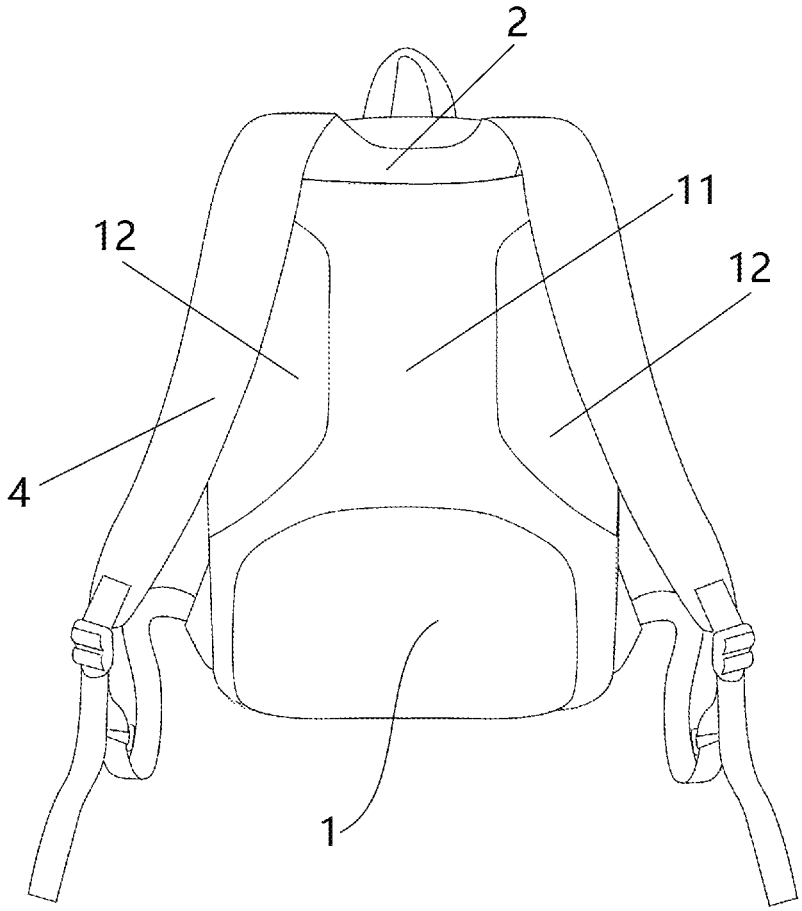
FIG. 1 is a schematic structural view of a pressure-relieving backpack of an embodiment according to the invention.

In drawings: 1, backpack body; 11, pocket; 12, protection pad; 2, pressure-relieving plate; 31, compression spring; 32, retractable rod; 321, first end of the retractable rod; 322, second end of the retractable rod; 323, limiting portion; 324, base; 325, groove; 326, connecting hole; 33, casing; 331, first clamp; 3310, slideway; 3311, first region; 3312, second region; 3313, limiting plate; 3314, bottom plate; 3315, second groove; and 4, shoulder strap.

DETAILED DESCRIPTION OF PREFERRED EMBODIMENTS

The specific implementations of the invention are further described in detail below with reference to the drawings and embodiments. The following embodiments are intended to illustrate the invention, but are not intended to limit the scope of the invention.

Refer to FIGS. 1 to 5, a pressure-relieving backpack according to the invention comprises a backpack body 1, a pressure-relieving plate 2, a pressure-relieving assembly, two shoulder straps 4, and a supporting plate for supporting the backpack body 1; the supporting plate is provided at a rear portion of the backpack body 1, and the pressure-relieving plate 2 is provided at a side of the rear part of the backpack body 1 near back (of a user);

the pressure-relieving assembly comprises a spring mechanism and a hollow casing 33; the casing 33 is mounted at the rear portion of the backpack body 1, and the spring mechanism is detachably disposed inside the casing 33;

the spring mechanism comprises a compression spring 31 and a retractable rod 32, the compression spring 31 is sleeved around and position-limited with respect to the retractable rod 32;

the casing 33 and the retractable rod 32 both have a first end and a second end; the second end 322 of the retractable rod 32 and the compression spring 31 are position-limited within the casing 33, the first end 321 of the retractable rod 32 is located outside the casing 33 and can be extended and retracted upward and downward relative to the first end of the casing 33;

the first end 321 of the retractable rod 32 is detachably connected to a lower end of the pressure-relieving plate 2, an upper end of the pressure-relieving plate 2 is connected to upper ends of the shoulder straps 4, and lower ends of the shoulder straps 4 are connected to a lower end of a back side of the backpack body 1.

Since the spring mechanism of the pressure-relieving assembly is detachably disposed in the casing 33, and the first end 321 of the retractable rod 32 is detachably connected to the lower end of the pressure-relieving plate 2, when the pressure-relieving backpack according to the invention is used in other load environments (e.g., in overload environment), a user can detach the first end 321 of the retractable rod 32 from the lower end of the pressure-relieving plate 2 and detach the spring mechanism from the casing 33, replace the original compression spring 31 on the retractable rod 32 with a new compression spring 31 that meets the use requirements in other load environments (e.g., in overload environment), and then reassemble the pressure-relieving assembly and remount the reassembled pressure-relieving assembly onto the backpack body 1.

Refer to FIGS. 2 to 5, the casing 33 comprises two clamps, an inner wall of each of the clamps protrudes outwardly to form a slideway, two slideways are oppositely disposed, and the retractable rod 32 is located in a chamber formed by the two slideways and can be extended and contracted upward and downward. Preferably, the two clamps have the same or substantially the same structure to ensure that the chamber formed by the two slideways 3310 enables the retractable rod 32 to perform freely telescopic movement.

For convenience of explanation of the mounting position relationship of the two clamps, herein the two clamps are respectively referred to as a first clamp 331 and a second clamp. The first clamp 331 is fixedly mounted on the rear portion of the backpack body 1 and the slideway 3310 of the first clamp 331 faces away from the backpack body 1, and the second clamp is detachably mounted on the first clamp 331.

In such manner of the first clamp 331 and the second clamp, the technical effect can be achieved that the spring mechanism is detachably disposed in the casing 33, and such manner facilitates the design and disassembly of the casing 33.

Figure 5:
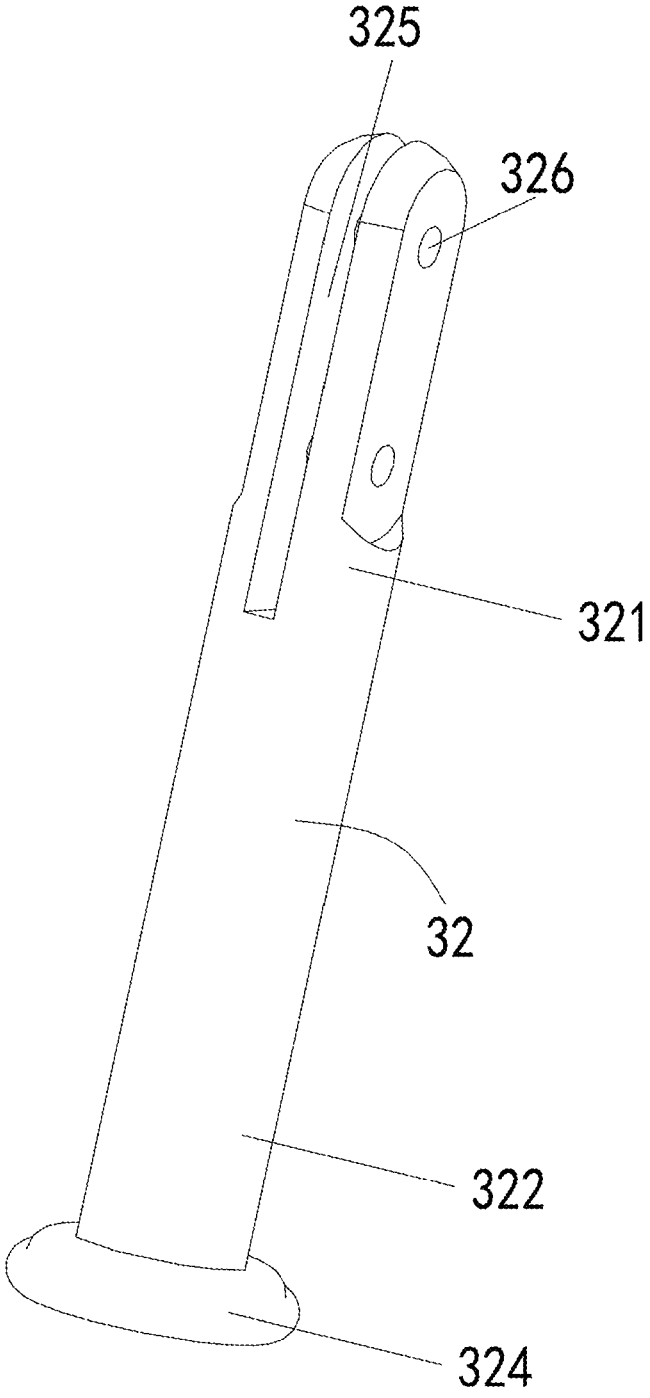
FIG. 5 is a schematic structural view of a retractable rod of a pressure-relieving backpack of an embodiment according to the invention.

As shown in FIG. 5, a bottom of the second end 322 of the retractable rod 32 is provided with a base 324, and the base 324 is position-limited within the chamber formed by the two slideways 3310 so as to ensure the safety performance and using performance of the pressure-relieving backpack of the embodiment according to the invention.

Refer to FIGS. 2 to 5, a lower end portion of each of the clamps is provided with a bottom plate 3314 for limiting downward movement of the base, and an upper end portion of each of the clamps is subjected to a "closing" process for limiting the compression springs 31.

Figure 2:
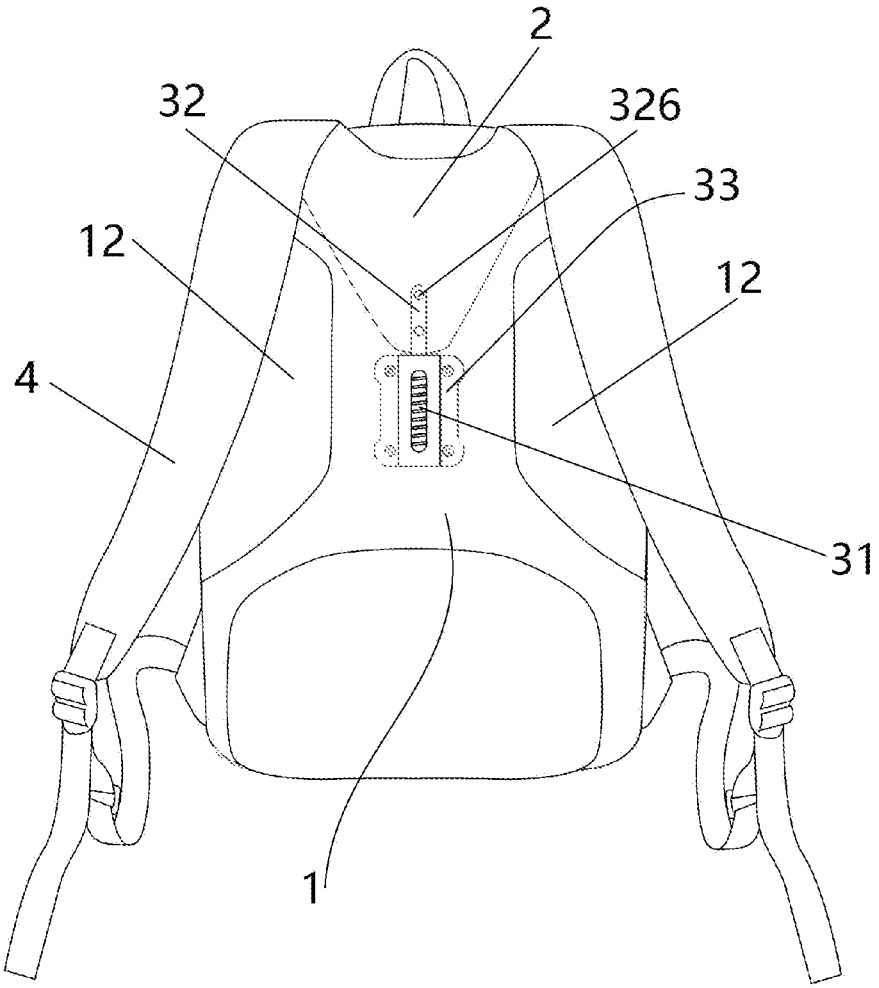
FIG. 2 is a schematic structural view of a pressure-relieving backpack without a pocket of an embodiment according to the invention.
Figure 3:
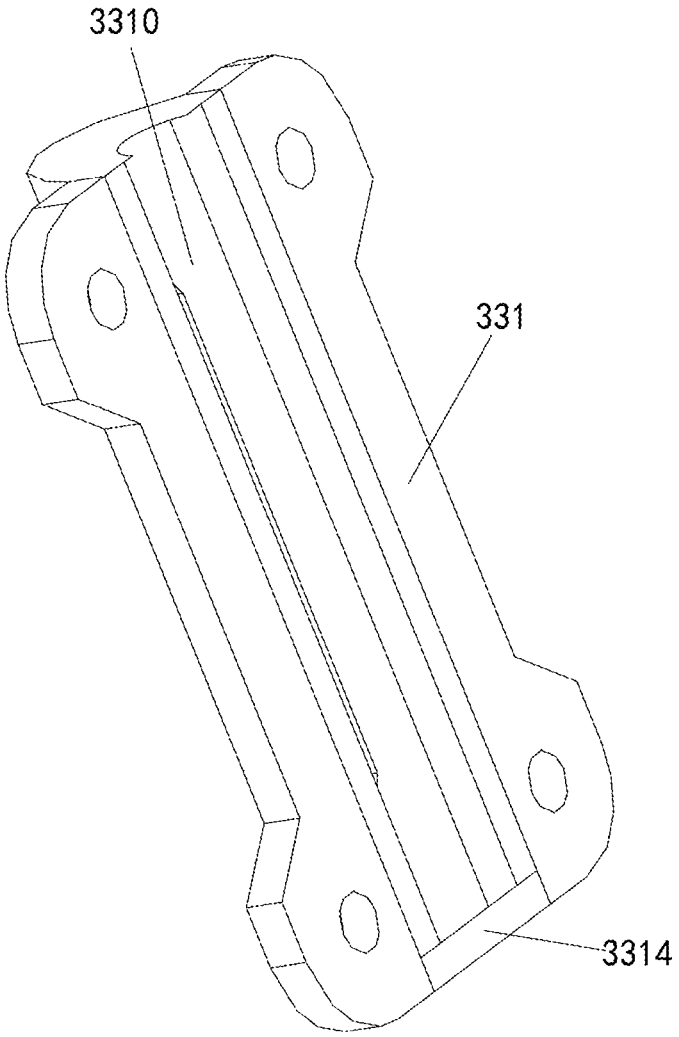
FIG. 3 is a schematic structural view I of a first clamp of a pressure-relieving backpack of an embodiment according to the invention.
Figure 4:
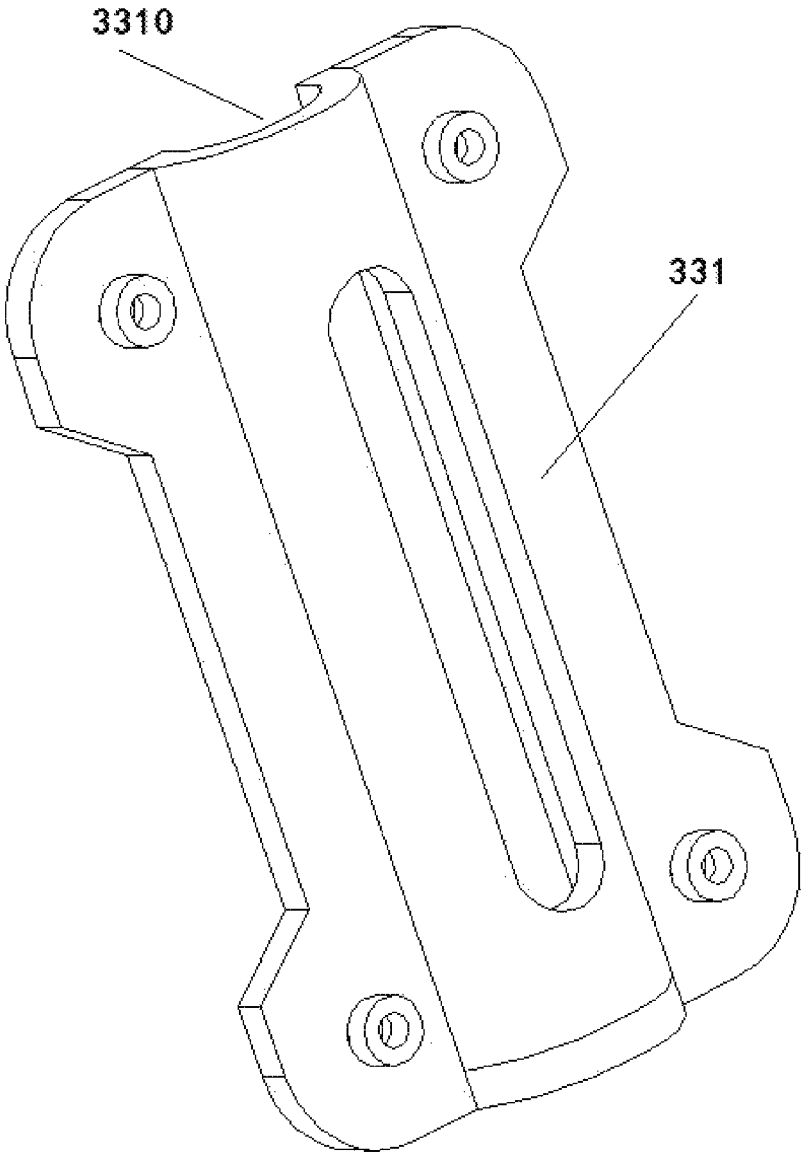
FIG. 4 is a schematic structural view II of a first clamp of a pressure-relieving backpack of an embodiment according to the invention.

Refer to FIGS. 2 and 5, a top of the first end 321 of the retractable rod 32 is provided with a groove 325 in an up-down direction, a thickness of the lower end of the pressure-relieving plate 2 matches with a width of the groove 325, and the lower end of the pressure-relieving plate 2 is detachably mounted in the groove 325. Setting of the groove 325 can not only achieve the technical purpose that the pressure-relieving plate 2 is detachable to the pressure-relieving assembly, but also ensure stable and reliable connection between the pressure-relieving plate 2 and the retractable rod 32, thereby ensuring the using performance and safety performance of the backpack.

Refer to FIGS. 2 and 5, an upper portion of the retractable rod 32 is horizontally provided with connecting holes 326 for realizing detachable connection between the lower end of the pressure-relieving plate 2 and the first end 321 of the retractable rod 32 through a connecting member. Preferably, there are two or more connecting holes 326, so that the safety performance of the backpack can be ensured to the maximum limit while ensuring that the pressure-relieving assembly can be detached.

An upper end of the side of the rear portion of the backpack body 1 near the back (of a user) is further provided with a limiting sleeve (not shown) that penetrates up and down, and a side of the pressure-relieving plate 2 opposite to the backpack body 1 is vertically provided with an elastic belt, an upper end of the elastic belt is connected to the upper end of the pressure-relieving plate 2, and a lower end of the elastic belt passes through the limiting sleeve and is connected to the lower end of the pressure-relieving plate 2. The limiting sleeve can limit the pressure-relieving plate 2 to a certain extent, and the elastic belt can further improve the pressure-relieving effect of the pressure-relieving backpack of the embodiment according to the invention.

Preferably, the rear portion of the backpack body 1 of the pressure-relieving backpack of the embodiment according to the invention is further provided with an isolation layer, and the support plate is disposed in the isolation layer, which can not only improve aesthetics of the backpack, but also extend the service life of the backpack.

Refer to FIGS. 1 and 2, the side of the rear portion of the backpack body 1 near the back (of a user) is further provided with a positioning portion for restricting left-and-right movement and front-and-rear movement of the pressure-relieving plate 2.

Preferably, the positioning portion is a pocket 11 with an opening formed upwardly, the pressure-relieving plate 2 and the pressure-relieving assembly are both disposed in the pocket 11 and can be extended and retracted up and down along the pocket 11.

Refer to FIGS. 1 and 2, the side of the rear portion of the backpack body 1 near the back (of a user) is further provided with two protection pads 12, and the two protection pads 12 are respectively disposed at two sides of the pocket 11. Preferably, the protection pads 12 are raised relative to the pocket 11, it can be ensured that air flows between the backpack and a user's back during usage of the backpack, thereby ensuring breathability of the backpack to increase comfort during usage of the backpack.

Figure 6:
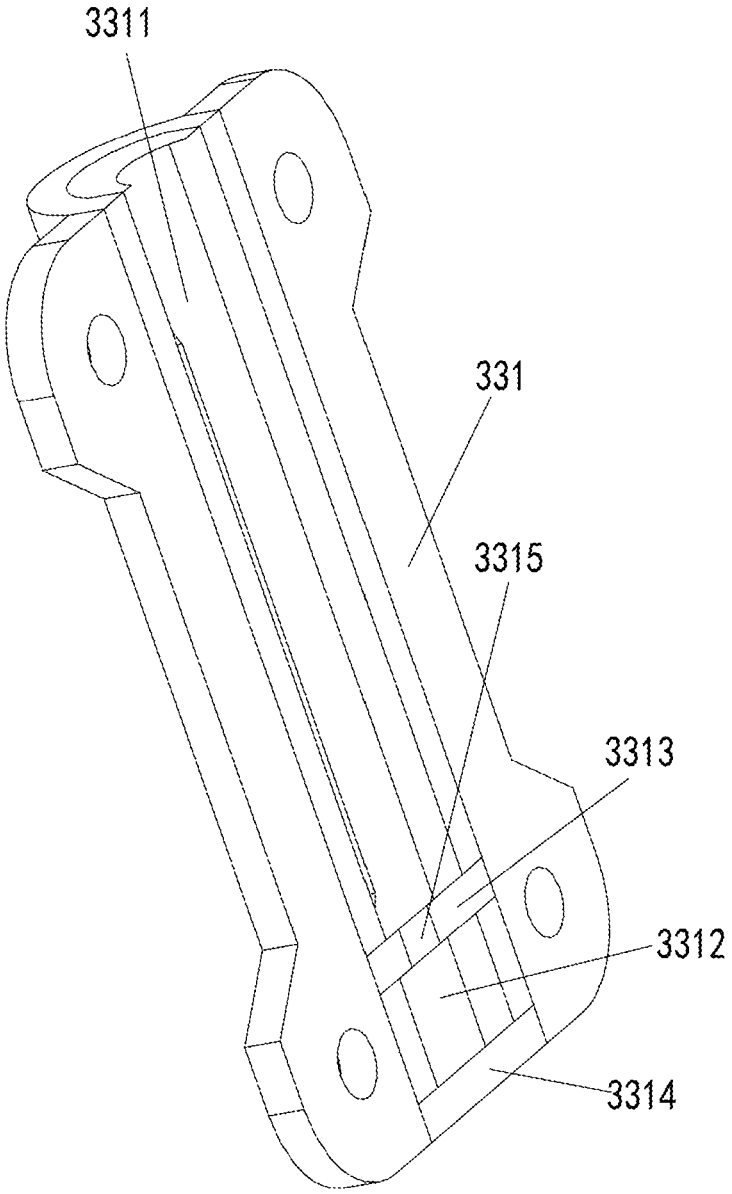
FIG. 6 is a schematic structural view of a first clamp of a pressure-relieving backpack of another embodiment according to the invention.
Figure 7:
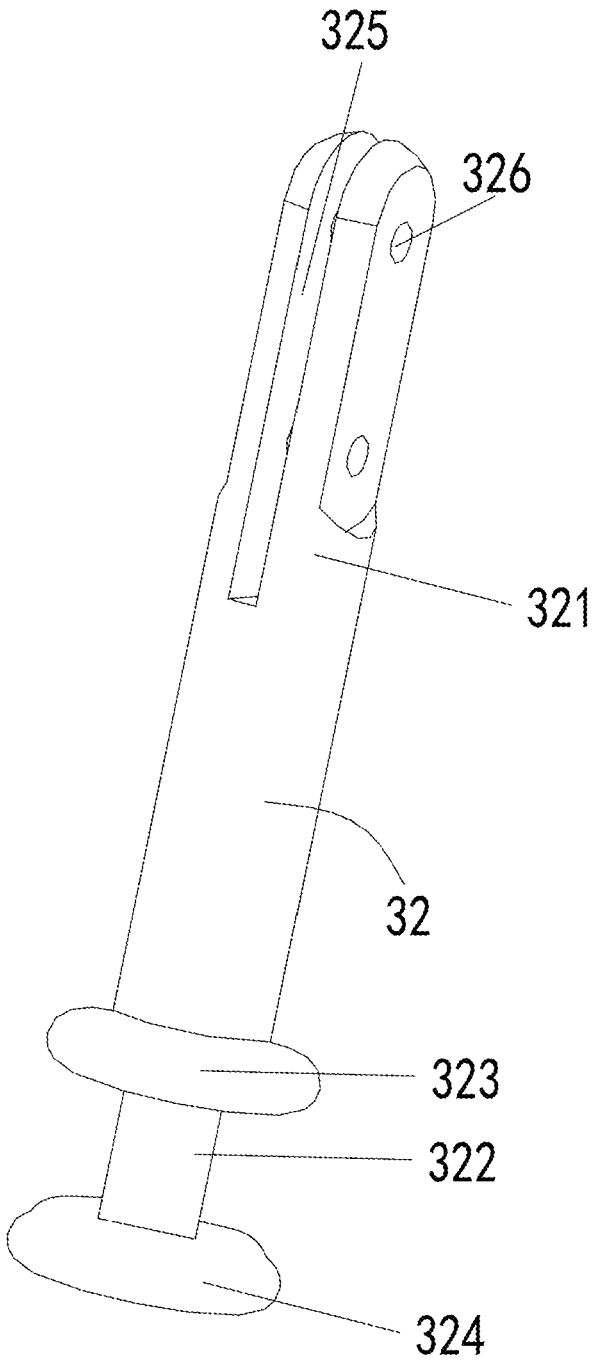
FIG. 7 is a structural schematic view of a retractable rod of a pressure-relieving backpack of another embodiment according to the invention.

Refer to FIGS. 6 and 7, in another embodiment, the pressure-relieving assembly is different from that of the aforementioned embodiment only in that: the inner side of each of the clamps may be provided with a limiting plate 3313 for dividing the slideway 3310 into a first region 3311 and a second region 3312, and the two limiting plates 3313 are symmetrically disposed;

The retractable rod 32 is provided with a limiting portion 323 which is position-limited in the chamber formed by the two first regions 3311; the compression spring 31 is position-limited to be between the first end of the casing 33 and the limiting portion 323, at this time, the base 324 disposed at the bottom of the second end 322 of the retractable rod is position-limited in the chamber formed by the two second regions 3312; the two limiting plates 3313 are each provided with a second groove 3315 for facilitating the passage of the retractable rod 32 from the limiting plates 3313; the two second grooves 3315 are symmetrically disposed; by providing the limiting plates 3313, the limiting portions 323 and the base 324, the safety performance and using performance of the pressure-relieving backpack of the embodiment according to the invention can be guaranteed to the maximum extent.

In conclusion, in the pressure-relieving backpack according to the invention, since the spring mechanism of the pressure-relieving assembly is detachably disposed in the casing 33, and the first end 321 of the retractable rod 32 is detachably connected to the lower end of the pressure-relieving plate 2, when the pressure-relieving backpack according to the invention is used in other load environments (e.g., in overload environment), a user can detach the first end 321 of the retractable rod 32 from the lower end of the pressure-relieving plate 2 and detach the spring mechanism from the casing 33, replace the original compression spring 31 on the retractable rod 32 with a new compression spring 31 that meets the use requirements in other load environments (e.g., in overload environment), and then reassemble the pressure-relieving assembly and remount the reassembled pressure-relieving assembly onto the backpack body 1. Therefore, the pressure-relieving backpack according to the invention can meet different load use requirements by replacing the compression spring 31 in the pressure-relieving assembly.

The above description is only preferred embodiments of the invention, and it should be noted that those skilled in the art can make several improvements and substitutions without departing from the technical principles of the invention, which improvements and substitutions are also considered to be the scope of protection of the invention.

What is claimed is:

1. A pressure-relieving backpack, wherein, the pressure-relieving backpack comprises: a backpack body (1), a pressure-relieving plate (2), a pressure-relieving assembly, two shoulder straps (4), and a supporting plate for supporting the backpack body (1); the supporting plate is provided at a rear portion of the backpack body (1), the pressure-relieving plate (2) is provided at a side of the rear portion of the backpack body (1) near the user's back;

the pressure-relieving assembly comprises a spring mechanism and a hollow casing (33); the casing (33) is mounted at the rear portion of the backpack body (1), and the spring mechanism is detachably provided inside the casing (33);

the spring mechanism comprises a compression spring (31) and a retractable rod (32), the compression spring (31) is sleeved around and position-limited with respect to the retractable rod (32);

the casing (33) and the retractable rod (32) both have a first end and a second end; the second end (322) of the retractable rod (32) and the compression spring (31) are position-limited within the casing (33), the first end (321) of the retractable rod (32) is located outside the casing (33) and can be extended and retracted upward and downward relative to the first end of the casing (33);

the first end (321) of the retractable rod (32) is detachably connected to a lower end of the pressure-relieving plate (2), an upper end of the pressure-relieving plate (2) is connected to upper ends of the shoulder straps (4), and lower ends of the shoulder straps (4) are connected to a lower end of a back side of the backpack body (1).

2. The pressure-relieving backpack according to claim 1, wherein the casing (33) comprises two clamps, an inner wall of each of the clamps protrudes outwardly to form a slideway (3310), two slideways (3310) are oppositely disposed, and the retractable rod (32) is located in a chamber formed by the two slideways (3310) and can be extended and contracted upward and downward;

the two clamps are respectively referred to as a first clamp (331) and a second clamp, the first clamp (331) is fixedly mounted on the rear portion of the backpack body (1), the slideway (3310) of the first clamp (331) faces away from the backpack body (1), and the second clamp is detachably mounted on the first clamp (331).

3. The pressure-relieving backpack according to claim 2, wherein a bottom of the second end (322) of the retractable rod (32) is provided with a base (324), and the base (324) is position-limited within the chamber formed by the two slideways (3310).

4. The pressure-relieving backpack according to claim 1, wherein a top of the first end (321) of the retractable rod (32) is provided with a groove (325) in an up-down direction, a thickness of the lower end of the pressure-relieving plate (2) matches with a width of the groove (325), and the lower end of the pressure-relieving plate (2) is detachably mounted in the groove (325).

5. The pressure-relieving backpack according to claim 4, wherein an upper portion of the retractable rod (32) is horizontally provided with connecting holes (326) for realizing detachable connection between the lower end of the pressure-relieving plate (2) and the first end (321) of the retractable rod (32) through a connecting member.

6. The pressure-relieving backpack according to claim 1, wherein an upper end of the side of the rear portion of the backpack body (1) near the user's back is further provided with a limiting sleeve that penetrates up and down, a side of the pressure-relieving plate (2) opposite to the backpack body (1) is vertically provided with an elastic belt, an upper end of the elastic belt is connected to the upper end of the pressure-relieving plate (2), and a lower end of the elastic belt passes through the limiting sleeve and is connected to the lower end of the pressure-relieving plate (2).

7. The pressure-relieving backpack according to claim 1, wherein the rear portion of the backpack body (1) is further provided with an insulation layer, and the supporting plate is disposed in the insulation layer.

8. The pressure-relieving backpack according to claim 1, wherein the side of the rear portion of the backpack body (1) near the user's back is further provided with a positioning portion for restricting left-and-right movement and front-and-rear movement of the pressure-relieving plate (2).

9. The pressure-relieving backpack of claim 8 wherein the positioning portion is a pocket (11) with an opening formed upwardly, the pressure-relieving plate (2) and the pressure-relieving assembly are both disposed in the pocket (11) and can be extended and retracted up and down along the pocket (11).

10. The pressure-relieving backpack according to claim 9, wherein the side of the rear portion of the backpack body (1) near the user's back is further provided with two protection pads (12), and the two protection pads (12) are respectively disposed at two sides of the pocket (11).

11. The pressure-relieving backpack according to claim 10, wherein the protection pads (12) are raised relative to the pocket (11).

* * * * *